United States Patent [19]

Stjernberg

[11] Patent Number: 4,778,066

[45] Date of Patent: Oct. 18, 1988

[54] SHELVING UNIT

[75] Inventor: Peter Stjernberg, Anderstorp, Sweden

[73] Assignee: Inter Ikea A/S, Humlebaeck, Denmark

[21] Appl. No.: 916,549

[22] PCT Filed: Dec. 16, 1985

[86] PCT No.: PCT/SE85/00525

§ 371 Date: Oct. 2, 1986

§ 102(e) Date: Oct. 2, 1986

[87] PCT Pub. No.: WO86/03661

PCT Pub. Date: Jul. 3, 1986

[30] Foreign Application Priority Data

Dec. 18, 1984 [SE] Sweden ..... 8406356

[51] Int. Cl.[4] ..... A47F 5/01

[52] U.S. Cl. ..... 211/186; 211/181; 211/182

[58] Field of Search ..... 211/182, 181, 186, 187, 211/189

[56] References Cited

U.S. PATENT DOCUMENTS

| | | | |
|---|---|---|---|
| 2,894,643 | 7/1959 | Maslow | 211/182 X |
| 2,919,816 | 1/1960 | Maslow | 211/182 X |
| 2,919,817 | 1/1960 | Maslow | 211/182 X |
| 3,208,408 | 9/1965 | Maslow | 211/186 X |
| 3,316,864 | 5/1967 | Maslow | 211/186 X |

FOREIGN PATENT DOCUMENTS

| | | | |
|---|---|---|---|
| 2451385 | 5/1976 | Fed. Rep. of Germany | 211/191 |

*Primary Examiner*—Robert W. Gibson, Jr.

*Attorney, Agent, or Firm*—Burns, Doane, Swecker & Mathis

[57] ABSTRACT

A shelving unit comprises side frames having pairs of vertical rods and transverse rods connecting these pairs; and shelf frames having pairs of longitudinally extending rods and transversely extending rods connecting these pairs. The shelf frames have, at the ends thereof, notches on the front and rear edges, the notches being adapted to cooperate with the vertical rods of the side frames. The transverse rods of the shelf frames are located inwardly of the notches to produce spring deformations of the end portions of the longitudinal rods.

14 Claims, 2 Drawing Sheets

SHELVING UNIT

TECHNICAL FIELD

This invention relates to a shelving unit assembly which comprises a number of ladder-like side frames and a number of shelf frames, or the like, which can be connected in various ways to the side frames whereby a varied assortment of shelving units of different shapes can be assembled.

PRIOR ART

Many systems are known in similar structures. In some cases, the component parts have been mainly made of wood, and despite the use of metal hardware, very high precision standards have been a requisite. Often, the finished shelving structure is so unsteady that either cross-bracing or back panels or similar stiffening means must be used.

In other cases, the shelving unit structures have been built entirely of metal components in which cases extremely high precision requirements must have been observed for the components to fit one another when assembled. In such structures, loosened screw joints or other connections have been the usual cause of unsteadiness and malfunctions. Consequently, such shelving structures have had to be provided with stiffening means such as cross-bracings, back panels, etc., in order to ensure their proper function.

U.S. Pat. No. 2,919,817 discloses a shelving unit which is a good example of such an older type of metal construction. The system of the U.S. patent comprises side frames designed in the form of a ladder with pairs of vertical rods extending along the front and rear edges of the side frames and with transverse rods extending therebetween, the transverse rods being secured, by welding, between the vertical rods of the side frames. The shelf frames are designed in a corresponding manner. They comprise parallel rods secured one upon the other along the front and rear edge, and transverse rod extending between the parallel rods and being secured, by welding, thereto. The transverse rods of the side frame support the shelf frames in the vertical direction. The shelf frames have ground notches at the ends of their rear and front edges, the notches being adapted to receive the vertical rods of the side frame. The design of the structure is such that the compressive force brought about between the notches of the shelf frames and the vertical rods of the side frames is sufficient to prevent the dislodgement of the shelving in normal use, without the necessity of using cross-bracing, back panels, etc.

According to the U.S. patent, the transverse rods of the shelf frames are mounted between the two notches in the longitudinal rods which receive both vertical rods of the side frame. Consequently, no possibility of springing effect and compensation for small dimensional deviations is left, neither in the side frame nor in the shelf frame, due to transverse rods being mounted in the shelf frames in the above-described manner. As a result, the notches in the shelf frames must be precision-ground to achieve close fit tolerances. This also means, of course, that a shelf frame which has been made to fit in a certain side frame at a specific place, does not necessarily fit another side frame or even the first frame at another place.

Further, the notches being ground out means that the contact surfaces of the vertical rods matching the notches are relatively small which results in highly concentrated loads and generally poor cohesion at the connections.

TECHNICAL PROBLEM

The object of the present invention is to overcome the above mentioned drawbacks of the prior art structures and to provide a shelving system of the type defined, which is made of welded metal components without excessive precision demands, wherein loosened connections or poor stability do no pose any problem, not even when back panels, cross-bracing and similar stabilizing means are omitted.

SOLUTION

According to the invention, there is provided a shelving unit or system comprising side frames with substantially vertical rods and transversely extending rods, and shelf frames having longitudinal rods and transverse rods, the longitudinally extending rods of the shelf frames having notches on their front and rear edges to cooperate with the vertical rods of the side frames when the shelf frames are inserted between the vertical rods and characterized in that the transverse rods of the shelf frames are disposed inwardly relative to the innermost notches in the longitudinal rods of the shelf frames.

This decision has a major advantage in that the longitudinal rods of the shelf frames are allowed to yield or spring back somewhat adjacent the notches. Thus, a compensation is provided for unavoidable tolerances of particular components of the shelving system.

In a preferred embodiment of the invention, the essentially vertical rods of the side frames are arranged in pairs with the transverse rods being disposed between each pair or rods and fastened thereto. Additionally, the longitudinal rods of the shelf frames are arranged in pairs, with transverse rods disposed between each pair of rods and fastened thereto. Preferably, this embodiment is characterized in that the notches are located to produce spring deformations in the substantially vertical rods of the side units.

The design according to the invention, aside from the above-mentioned resiliency, also provides the possibility of resilient deformations in the side frames, wherein these deformations are independent of those in the shelf frames, and the plane of the deformations is parallel to the planes which are defined by each pair of vertical rods of the side frames.

FURTHER TECHNICAL PROBLEM

The invention also provides a method of manufacturing the shelving unit of the type specified above, the method to produce a more stable, simple and inexpensive product.

FURTHER SOLUTION

According to the invention, the manufacturing is done in stages; side frames are made of pairs of substantially vertical rods which are connected with transverse rods, and shelf frames are made of pairs of longitudinal rods which are connected with transverse rods, notches being provided in the longitudinal rods at the front and rear edges of the shelf frames, said notches being adapted to engaged the substantially vertical rods of the sides frames when the shelf frames are inserted therebetween and is characterized in that the notches are made by plastic working of the longitudinal rods of the shelf frames, wherein the vertical cross-section of the rods in the area of the notches becomes enlarged.

These features allow, firstly, a very fast and inexpensive production of the shelving units of the invention and, secondly, provide for considerably greater contact surfaces of the notches for the vertical rods of the side frames, particularly in their longitudinal direction.

BRIEF DESCRIPTION OF THE DRAWINGS

The invention is to be described more in detail below, reference is being had to the accompanying drawings on which.

PREFERRED EMBODIMENT

The basic idea behind the invention is that the inventive shelf unit should be stable and substantially rigid without the use of cross-bracing or the like and inspite of the fact that the components constituting the shelf unit could be allowed to have moderate or, even, bad tolerances. According to the invention there is, therefore, created a number of mutually independent spring deformations in the components constituting the shelf unit, thus obtaining both great clamping forces and compensation of the tolerances. By using several independent spring deformations there is, as a whole, achieved great spring forces, long spring lengths and spring forces varying only slightly within the spring length. Such spring deformations are created in several different components and, possibly, in several different directions in each component.

The spring deformations mentioned above also produces biasing forces in one or more of the components constituting the shelf unit thereby to improve stability.

Figure 1:
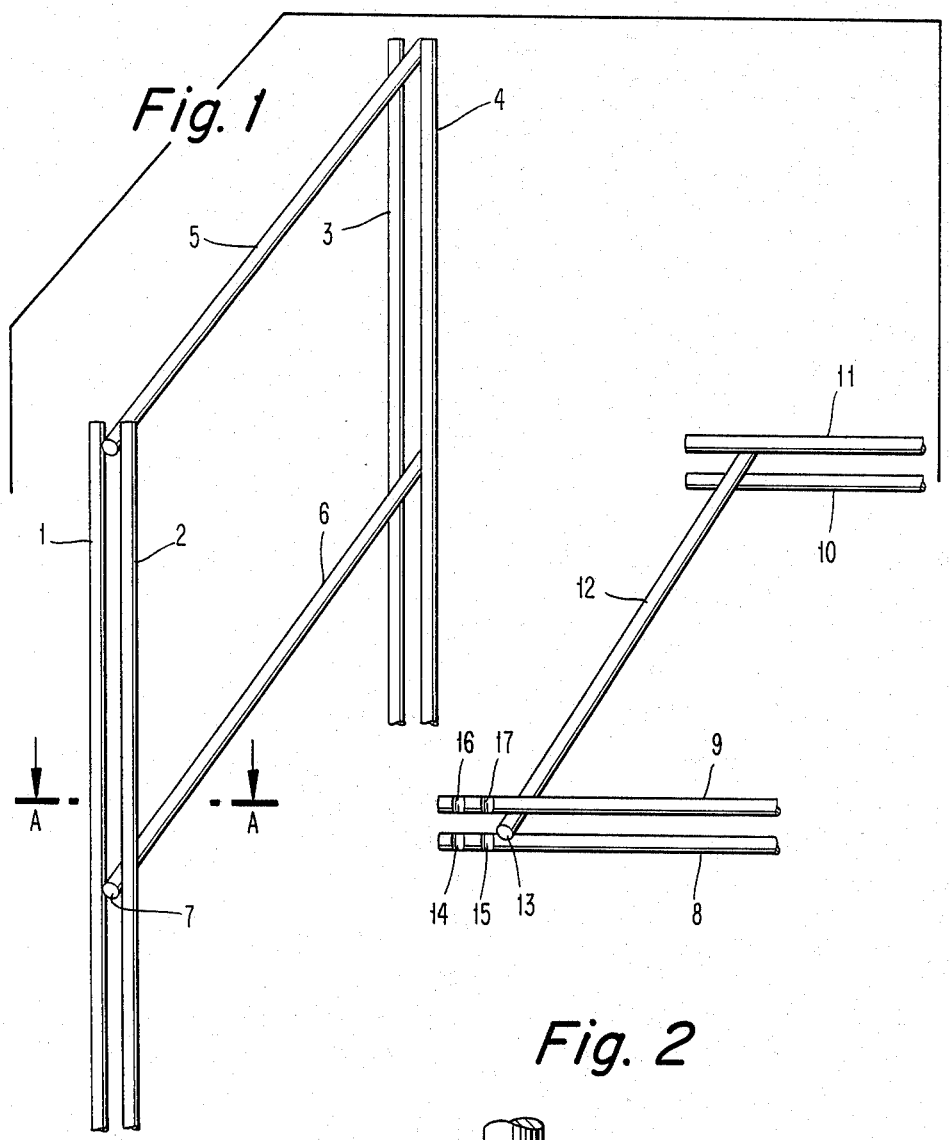
FIG. 1 is a perspective view of a side frame and a shelf frame to be connected thereto.

As shown in FIG. 1, the shelving unit comprises a side frame which consists of two pairs of vertical rods, viz. two front vertical rods 1, 2 and two rear vertical rods 3, 4. These two pairs or rods are connected together by substantially horizontal crossbars 5, 6 spaced regularly or non-regularly. The cross-bars are secured, by welding, between the vertical rods.

Figure 2:
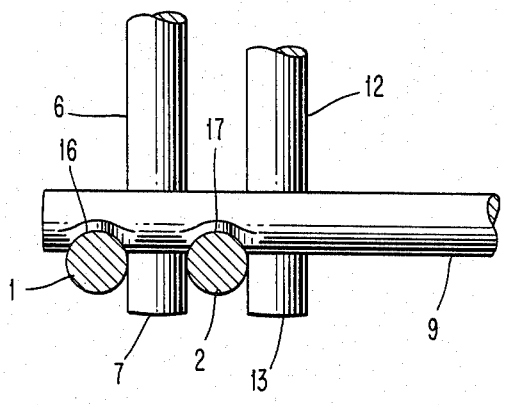
FIG. 2 is a sectional view, approximately of the line A—A of FIG. 1.

As shown in FIG. 2, the end portions 7 of the horizontal and transverse rods 5, 6 can project slightly from the front or rear side of the vertical rods.

The horizontal and transverse rods 5 and 6 may have various spacing in the vertical direction and are preferably disposed at a right angle to the vertical rods. It is possible to arrange for the shelf frames to be disposed at many different heights on the side frames by the use of a suitable number of cross-bars 5 and 6, since the vertical rods constitute supports of the shelf frames.

It is also possible to employ one or more cross-bars corresponding to the horizontal rods 5 and 6, the cross-bars being disposed at an angle to the vertical rods 1–4, e.g. in order to support an inclined newspaper shelf or the like.

Principally, the shelf frames are constructed similarly to the side frames, and accordingly, they comprise a pair of horizontal longitudinal rods, 8 and 9, disposed one over the other at the front edge of the shelf frame, and similar rods 10, 11 at the rear edge. At both ends of the shelf frame are mounted transversely extending rods 12, which are secured, by welding, between the longitudinal rods. The transversely extending rods 12 (of the shelf frames) can also be provided with end portions, similar to those of the rods 5, 6, which protrude somewhat over the front edge and behind the rear edge of the shelf frame.

FIG. 1 shows only a single transverse rod 12, but of course another corresponding rod is provided at the opposite end of the shelf frame. Further, one or more corresponding transverse rods may be provided in the middle area of the shelf frame. However, it may be detrimental to provide a transverse rod too close to the border rods. The reasons for this caution will be explained hereinafter. The cross bar 12 and possible further cross bars are fastened to the longitudinal rods 8 and 9 in such a way that the latter ones are prevented from moving in their longitudinal directions.

As a means of joining the shelf frames and the side frames, the longitudinal rods 8, 9, 10, 11 have, on the front and rear edges, substantially cylindric notches or indentations 14, 15, 16, 17 on their end portions outside both the transverse rods 12, the notches or indentations being disposed on the side of the rods facing the vertical rods 1, 2, 3, 4. The notches or indentations are disposed so that they partially receive the vertical rods 1–4 of the side frames when the shelf frame is inserted into the side frame diagonally to the transverse rod 6 and is subsequently brought down and parallel thereto. This is clearly shown in FIG. 2. As the longitudinal rods 8, 9, 10, 11 could not be longitudinally displaced relatively each other, and further, if it is possible to ascertain large contact surfaces and an adequate pressure with which the longitudinal rods 8, 9, 10, 11 abut against the inner side of the vertical rods 1, 2, 3, 4, the connection between the shelf frames and the side unit accomplished through the notches 14 - 17 is extremely stable, so much so, that no other reinforcement between the shelf frames and side frames is necessary. Actually, the construction is so stable that even cross-bracings, back panels, etc., can be omitted.

What is said above could also be expressed in such terms that biasing forces are created, by means of spring deformations, in one or more of the rods used in the shelf unit.

The horizontal transverse cross cross-bars 5 and 6 are disposed in the side frames between the vertical rods 1–4. This means that the vertical rods 1–4 must be considered as rigid and non-movable in the longitudinal direction of the rods 5, 6, at least in the area close to these rods, or at least so difficult to move having so hard spring action that extremely great forces would be necessary to produce even very small displacements. In order to avoid, in such a situation unrealistically high precision demands regarding the shelf frames as well as the requirements regarding the assembling of the side frames, the invention provides for a springing cooperation of the components. This is achieved owing to the transverse rods 12 being disposed inwardly of the inner notches 15, 17 rather than within the area defined by the opposite notches 14, 16 and 15, 17. The free ends of the rods 8, 9 and 10, 11 having the recesses 14–17, protrude beyond the junction with the rod 12. Therefore, when the shelf frames are pressed between the pairs of rods 1, 2 and 3, 4, the free ends protruding beyond the transverse rods 12 come somewhat nearer to each other. Such a forced insertion can be accomplished through a small deflection of the rods 12, but primarily through a deflection of the longitudinal rods 8–11. The obvious prerequisite for the deflection of the transverse rods 12 is that the welded joint between the rods 12 and the rods 8–11 must be resistant to bending, and further, that there is no further transverse rod close to the transverse rod 12.

In the embodiment shown in FIG. 2, the transverse rod 12 of the shelf frame is so disposed that it abuts against both inner vertical rods 2, 4 of the side frame. This embodiment may prove advantageous when the dimensions of the shelving unit are relatively small and consequently, the appertaining rods are of relatively small diameter and thus their elasticity is relatively high.

It was mentioned hereinabove that no other connections should be provided between the longitudinal rods 8–11 close to the transverse rods 12 and inside thereof, since such connections would hinder possibility of deflection of the longitudinal rods.

By means of the possible spring action achieved by the location, as mentioned above, of the cross rods 12 of the shelf frames there could be attained means for compensating varying depths of the notches 14–17, varying positions of the connections between the cross rods 12 and the longitudinal rods 8–11 and, finally, also for varying positions of the joints between the cross rods 5 and 6 and the vertical rods 1–4 of the side frames.

Both external notches 14, 16 on the longitudinal rods 8–11 are disposed on a longer lever arm relative to the rods 12 (than the inner notches 15, 17). As a result, an equal force exerted onto the outer notches 14, 16 brings about a greater deflection (of the end portions) than in the case of the inner recesses 15, 17. As a remedy, and to obtain an essentially uniform pressure between the particular notches and the vertical rods 1–4 in the side frames, the outer recesses 14, 16 may be made slightly more shallow than the inner recesses 15, 17. Another possibility is, to bend the end portions of the rods 8–11, extending beyond the cross-bars 12, slightly outwardly.

Figure 3:
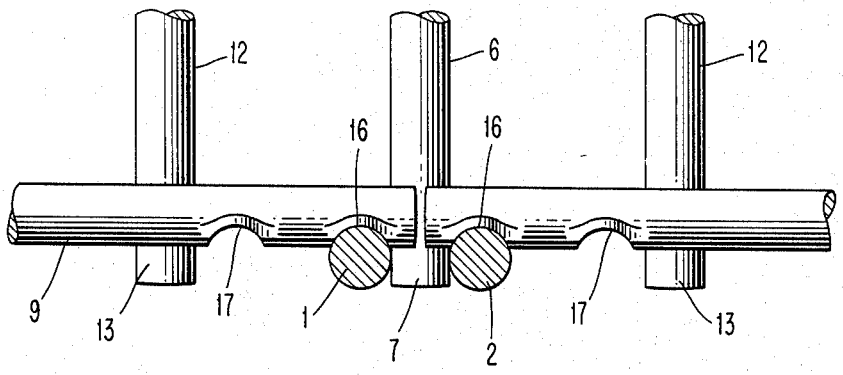
FIG. 3 is a section corresponding to the section A—A of FIG. 1, with two shelf frames being attached to one side frame.

In FIG. 3 there is shown an embodiment in which two separate shelf frames are connected with a common side unit. It can be clearly seen that only the outer recesses 14, 16 of each shelf frame have been used, therefore this embodiment preferably calls for the above-described methods of increasing the pressure between the outer notches and the side unit.

FURTHER EMBODIMENTS

Figure 4:
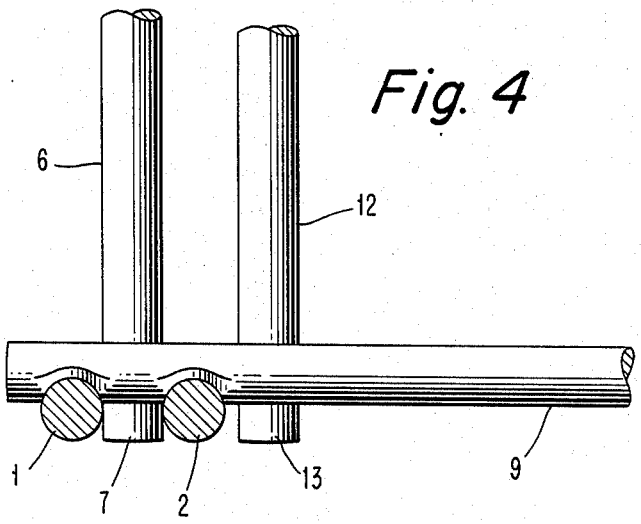
FIG. 4 is a sectional view of another, modified embodiment, wherein the section corresponds to the section A—A in FIG. 1.

FIG. 4 illustrates a modified embodiment particularly well adapted for bigger shelf units using relatively thick material in the rods. In this embodiment the transverse rods 12 are mounted more inwardly towards the middle of the shelf frame than in the previous embodiment, the distance between the rods 12 and the rods 2, 4 being preferably from about 1 mm to about 1 cm or a couple of centimeters. Thence, the end portions of the longitudinal rods 8–11, having the notches 14–17 are longer, whereby springing ability become correspondingly greater.

Figure 5:
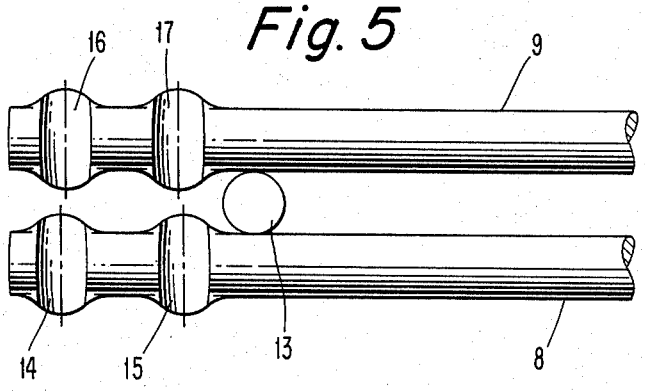
FIG. 5 is a local view of one corner area of the shelf frame.

A further modified embodiment of the invention is illustrated in FIG. 5. The upper notches 16, 17 in the longitudinal rods 9, 11 of the shelf frame are disposed slightly closer to each other than the lower notches 14, 15 in the rods 8, 10. The centre distances between the lower notches 14, 15 are selected so they coincide with the centre distances of the vertical rods 1–4 of the side frames. On the other hand, the centre distances of the upper notches 16, 17 are somewhat smaller than the centre distances of the vertical rods of the side frames, so that the vertical rods 1, 2 or 3, 4 are pressed together in the two respective planes containing the center lines or the vertical rods 1, 2 and 3, 4.

Of course, the size of the difference in centre distances (axial distances) between the upper notches 16, 17 and the lower notches 14, 15 depends on the ultimate dimensions of the shelving unit and, naturally on the rigidity of the rods of which the system is built. Depending on the dimensions of the shelving unit and particularly the diameter of the rods used, the difference in centre distance between the upper notches 16, 17 and the lower notches 14, 15 may vary from about 0.1 mm to about 1 mm.

Obviously it is also conceivable, according to the invention, to provide a greater distance between the notches 16, 17 than that between the lower notches 14, 15. Still, the centre distance of the lower notches should, of course, coincide with the axial distances of the vertical rods 1, 2 or 3, 4.

The above-described centre distance variations between the upper and the lower recesses 16, 17 or 14, 15 permit elastic deflections in the vertical rods 1–4 of the side frame, mainly in directions that are parallel to the planes defined by the pairs of rods of the side frames. Variations in the position of the transverse rods 12 along the longitudinal rods 8–11, in the depth of the notches 14–17 as well as variations of the flexures, if any, of the longitudinal rods 8–11 affect the springing in the shelf frame itself, such springing mainly being achieved by deflecting the respective longitudinal rods 8, 10 and 9, 11 toward each other. Thus it is possible to obtain springing both in the side frames and in the shelf frames, such springings hardly influencing each other, but could be used independently.

In a further modified embodiment of the inventions, both upper recesses 16, 17 in the longitudinal rods 9, 11 can be displaced laterally relative to the lower recesses 14, 15. Of course, the displacement of the upper notches must be effected in opposite directions at both ends of the shelf structure in order to maintain a symmetry of the shelving unit. The displacement may be effected not only inwardly, towards the middle of the shelf frame, but also outwardly thereof. In these versions, the centre distances between the respective upper notches 16, 17 and the respective lower notches 14, 15 should coincide with the centre distances of the vertical rods 1, 2 or 3, 4 of the side units. Of course, different centre distances can be employed as well.

The above-described lateral displacement of the notches offers also a possibility of springing deflection, which mainly leaves the shelf frames unaffected but affects the side frames in such a way that the vertical rods 1–4 are deformed in directions contained in those planes defined by pairs of rods 1, 2 and 3, 4 respectively.

In a further embodiment, the longitudinal rods 9, 11 of the shelf frames are not disposed directly over the lower rods 8, 10 but their spacing is slightly greater. Consequently, a deformation must occur in the shelving system during its assembly. This deformation affects both the shelf frame structure and the side frame, wherein the elastic deformation caused in the shelf frame results in a sagging deflection of the rods 12 in their middle areas. Corresponding, the elastic deformation causes a deflection of the vertical rods 1–4 of the side frame in the areas disposed between the transverse rods 5 and 6. This embodiment can also, of course, be combined with any of the embodiments described hereinabove.

The shelving units of the invention are manufactured mainly in conventional workshops. Thus, the side units and shelf frames are cut and welded in an entirely conventional manner.

As far as the manufacturing of the shelf frames is concerned, however, it must be pointed out that the notches or recesses 14–17 in the rods 8–11 are made by a plastic working process. The process causes the material from the recesses to be pressed out. The flow of the material is controlled so that it occurs mainly in the vertical direction, whereby, the longitudinal rods 8–11 are substantially enlarged at 20 in the vertical direction in the area of the notches. As a result, the notches 14–17 become approximately cylindrical contact surfaces for the vertical rods of the side frames wherein the length, i.e., vertical span of these contact surfaces is considerably greater than the diameter of the longitudinal rods 8–11 of the shelf frames. Assuming the diameter of the longitudinal rods of the shelf frames to be 7 mm, the longitudinal vertical extension of the contact surfaces of the notches 14–17 can reach about 10 mm. This amounts to about 50% increase in the contact surface and, above all, in its heigt.

The notches 14–17 are formed practically in a following manner. After the longitudinal rods 8–11 have been welded to the transverse rods 12, a stamp, having the desired recess shape is pressed into the longitudinal rods 8–11. During this pressing by the stamp the material of the longitudinal rods is left unsupported or unconfined in such a way that the flow of material will become directed longitudinally of the notches, i.e. in the vertical direction.

The invention lends itself to further modifications within the scope of the patent claims. It is possible to employ the above-described features in various combinations to achieve an increased pressure between the side structures and the shelf frames, whereby many various spring effects are utilized simultaneously. Of particular advantage is the combination of such spring actions which effect independent deformations in the shelf frame and in the side unit. Due to these springing possibilities, the range of tolerance can be doubled without involving the risk of a loose seat or poor stability of the shelving unit structure.

I claim:

1. A shelf unit comprising:

side frames each including transversely spaced pairs of front and rear vertical rods and first transverse rods extending from one said pair of vertical rods to another such pair and being disposed between said front and rear vertical rods of each pair and fastened thereto, and shelf frames each including spaced pairs of front and rear longitudinal rods and second transverse rods extending from one said pair of longitudinal rods to another such pair and being disposed between said front and rear longitudinal rods of each said pair thereof and fastened thereto, said pairs of front and rear longitudinal rods each including end portions disposed between said transversely spaced pairs of vertical rods, each of said end portions including a pair of longitudinally spaced notches facing transversely outwardly and receiving therein respective ones of said vertical rods, each of said end portions, including said pair of notches, extending longitudinally beyond said second transverse rods such that said end portions are transversely resiliently deformable, said end portions being resiliently deformed transversely inwardly toward one another due to contact with said vertical rods so as to continuously exert transversely outwardly directed gripping forces against said vertical rods and thereby tightly secure said shelf frames to said side frames.

2. A shelf unit comprising:

side frames each including transversely spaced pairs of front and rear vertical rods and first transverse rods extending from one said pair of vertical rods to another such pair and being disposed between said front and rear vertical rods of each pair and fastened thereto, and shelf frames each including spaced pairs of front and rear longitudinal rods and second transverse rods extending from one said pair of longitudinal rods to another such pair and being disposed between said front and rear longitudinal rods of each said pair thereof and fastened thereto, said pairs of front and rear longitudinal rods each including end portions disposed between said transversely spaced pairs of vertical rods, each of said end portions including a pair of longitudinally spaced pressed-in notches facing transversely outwardly and receiving therein respective ones of said vertical rods, each of said end portions, including said pair of notches, extending longitudinally beyond said second transverse rods, said notches being pressed-in such that said notches have larger vertical cross-sectional dimensions than remaining portions of said longitudinal rods.

3. A shelving unit system comprising side frames having substantially vertical rods and transverse rods, and shelf frames having longitudinal rods and transverse rods, the longitudinal rods of the shelf frames having notches at front and rear edges of the shelf frames, the notches being adapted to cooperate with the substantially vertical rods of the side frames, the substantially vertical rods of the side frames being provided in pairs, and the transverse rods being fastened between each pair of the rods, the longitudinal rods of the shelf frames being arranged in pairs and the transverse rods being fastened between each pair of the rods, characterized in that the transverse rods of the shelf frames being disposed inwardly relative to the innermost notches of the longitudinal rods of the shelf frames, the notches being so arranged as to provide elastic deformations of the vertical rods of the side frames, the notches in the lower longitudinal rods of the shelf frames being spaced from each other, the spacing corresponding to that of the pairs of vertical rods of the side frame, while the notches in upper longitudinal rods of the shelf frames have a different spacing.

4. A shelving unit system comprising side frames having substantially vertical rods and transverse rods, and shelf frames having longitudinal rods and transverse rods, the longitudinal rods of the shelf frames having notches at front and rear edges of the shelf frames, the notches being adapted to cooperate with the substantially vertical rods of the side frames, the substantially vertical rods of the side frames being provided in pairs, and the transverse rods being fastened between each pair of the rods, the longitudinal rods of the shelf frames being arranged in pairs and the transverse rods being fastened between each pair of the rods, characterized in that the transverse rods of the shelf frames being disposed inwardly relative to the innermost notches of the longitudinal rods of the shelf frames, the notches being so arranged as to provide elastic deformations of the vertical rods of the side frames, the notches in the upper ones of the longitudinal rods of the shelf frames being displaced laterally relative to the notches in the lower longitudinal rods.

5. A shelving unit comprising side frames having substantially vertical rods and transverse rods, and shelf frames having longitudinal rods and transverse rods, the longitudinal rods of the shelf frames having notches being adapted to cooperate with the substantially vertical rods of the side frames, characterized in that the transverse rods of the shelf frames being disposed inwardly relative to the innermost notches of the longitudinal rods of the shelf frames, the outer notches of the longitudinal rods of the shelf frames being shallower than inner notches thereof.

6. A shelving unit comprising side frames having substantially vertical rods and transverse rods, and shelf frames having longitudinal rods and transverse rods, the longitudinal rods of the shelf frames having notches being adapted to cooperate with the substantially vertical rods of the side frames, where the rods extending along the longitudinal edges of the shelf frames are disposed one upon the other, characterized in that the transverse rods of the shelf frames being disposed inwardly relative to the innermost notches of the longitudinal rods of the shelf frames, the spacing between the upper longitudinal rods being different from the spacing between the lower longitudinal rods.

7. A shelving unit comprising side frames having substantially vertical rods and transverse rods, and shelf frames having longitudinal rods and transverse rods, the longitudinal rods of the shelf frames having notches being adapted to cooperate with the substantially vertical rods of the side frames, the substantially vertical rods of the side frames being provided in pairs, and the transverse rods being fastened between each pair of the rods, the longitudinal rods of the shelf frames being arranged in pairs and the transverse rods being fastened between each pair of the rods, characterized in that the transverse rods of the shelf frames being disposed inwardly relative to the innermost notches of the longitudinal rods of the shelf frames, the notches being so arranged as to provide elastic deformations of the vertical rods of the side frames, the outer notches of the longitudinal rods of the shelf frames being shallower than inner notches thereof.

8. A shelving unit comprising side frames having substantially vertical rods and transverse rods, and shelf frames having longitudinal rods and transverse rods, the longitudinal rods of the shelf frames having notches being adapted to cooperate with the substantially vertical rods of the side frames, the substantially vertical rods of the side frames being provided in pairs, and the transverse rods being fastened between each pair of the rods, the longitudinal rods of the shelf frames being arranged in pairs and the transverse rods being fastened between each pair of the rods, the rods extending along the longitudinal edges of the shelf frames being disposed one upon the other, characterized in that the transverse rods of the shelf frames being disposed inwardly relative to that innermost notches of the longitudinal rods of the shelf frames, the notches being so arranged as to provide elastic deformations of the vertical rods of the side frames, the spacing between the upper longtudinal rods being different from the spacing between the lower longitudinal rods.

9. A shelving unit system according to claim 1, characterized in that the notches in the lower longitudinal rods of the shelf frames are spaced from each other, the spacing corresponding to that of the pairs of vertical rods of the side frame, while the notches in upper longitudinal rods of the shelf frames have a different spacing.

10. A shelving unit system according to claim 1, characterized in that the notches in the upper ones of the longitudinal rods of the shelf frames are displaced laterally relative to the notches in the lower longitudinal rods.

11. A shelving unit system according to claim 1, characterized in that, the outer notches of the longitudinal rods of the shelf frames are shallower than inner notches thereof.

12. A shelving unit system according to claim 1, and where the rods extending along the longitudinal edges of the shelf frames are disposed one upon the other, characterized in that the spacing between the upper longitudinal rods is different from the spacing between the lower longitudinal rods.

13. A shelving unit system according to claim 2, characterized in that the notches in the upper ones of the longitudinal rods of the shelf frames are displaced laterally relative to the notches in the lower longitudinal rods.

14. A shelving unit system according to claim 2, characterized in that, the outer notches of the longitudinal rods of the shelf frames are shallower than inner notches thereof

* * * * *